US010508453B2

(12) United States Patent
Caimi

(10) Patent No.: US 10,508,453 B2
(45) Date of Patent: Dec. 17, 2019

(54) SOUND-ABSORBING ELEMENT AND SYSTEM

(71) Applicant: ELEDA S.R.L., Milan (IT)

(72) Inventor: Renato Caimi, Milan (IT)

(73) Assignee: ELEDA S.R.L., Milan (IT)

( * ) Notice: Subject to any disclaimer, the term of this patent is extended or adjusted under 35 U.S.C. 154(b) by 243 days.

(21) Appl. No.: 15/531,523

(22) PCT Filed: Dec. 3, 2015

(86) PCT No.: PCT/EP2015/078528
§ 371 (c)(1),
(2) Date: May 30, 2017

(87) PCT Pub. No.: WO2016/087587
PCT Pub. Date: Jun. 9, 2016

(65) Prior Publication Data

US 2017/0342721 A1 Nov. 30, 2017

(30) Foreign Application Priority Data

Dec. 5, 2014 (IT) ..... MI14A002092

(51) Int. Cl.
*E04B 1/84* (2006.01)
*E04B 1/82* (2006.01)
(Continued)

(52) U.S. Cl.
CPC ..... *E04F 13/002* (2013.01); *E04B 1/8409* (2013.01); *E04B 9/001* (2013.01);
(Continued)

(58) Field of Classification Search
CPC . E04B 1/84; E04B 1/8409; E04B 1/82; E04B 1/99; E04B 9/00; E04B 9/34;
(Continued)

(56) References Cited

U.S. PATENT DOCUMENTS 2,502,016 A * 3/1950 Olson ..... G10K 11/16 181/295
2,935,151 A * 5/1960 Watters ..... E04B 9/34 181/289
(Continued)

FOREIGN PATENT DOCUMENTS

EP 0 295 925 12/1988
EP 0 816 583 1/1998
(Continued)

OTHER PUBLICATIONS

International Search Report for PCT/EP2015/078528 dated Jan. 19, 2016, 3 pages.
(Continued)

*Primary Examiner* — Edgardo San Martin
(74) *Attorney, Agent, or Firm* — Nixon & Vanderhye P.C.

(57) ABSTRACT

A sound-absorbing element and a sound-absorbing system comprising a fibrous material having the following properties is described: specific airflow resistance comprised between 527 and 1552 [Pa s/m]; and mass porosity comprised between 66% and 79%.

10 Claims, 14 Drawing Sheets

(51) Int. Cl.

| | |
|---|---|
| ***E04F 13/08*** | (2006.01) |
| ***E04F 13/00*** | (2006.01) |
| ***E04B 9/00*** | (2006.01) |
| *G10K 11/16* | (2006.01) |

(52) U.S. Cl.
CPC .. *E04F 13/0867* (2013.01); *E04B 2001/8281* (2013.01); *E04F 2290/042* (2013.01)

(58) Field of Classification Search
CPC .... E04B 9/30; E04B 9/001; E04B 2001/8281; E04F 13/00; E04F 13/08; E04F 13/002; E04F 13/0867; E04F 2290/042; G10K 11/16
See application file for complete search history.

(56) References Cited

U.S. PATENT DOCUMENTS 5,750,944 A * 5/1998 Fuchs ..... G10K 11/168 181/286
5,832,685 A * 11/1998 Hermanson ..... E04B 9/001 52/506.07
7,677,359 B2 * 3/2010 Vigran ..... E04B 1/86 181/286
7,686,132 B2 * 3/2010 Olson ..... B32B 5/26 181/286
9,194,124 B2 * 11/2015 Johnson ..... E04B 9/32
9,613,609 B2 4/2017 Caimi
2003/0134553 A1 * 7/2003 Sheffer ..... B32B 3/26 442/120

FOREIGN PATENT DOCUMENTS

| | | |
|---|---|---|
| EP | 0 872 586 | 10/1998 |
| EP | 2 472 018 | 7/2012 |
| GB | 2 063 960 | 6/1981 |
| WO | WO 2013/113800 | 8/2013 |

OTHER PUBLICATIONS

Norma Italiana, Acoustics—Measurement of sound absorption in a reverberation room, UNI EN ISO 354, Dec. 2003, 32 pages.
Norma Italiana, Textiles—Determination of thickness of textiles and textile products, UNI EN ISO 5084, Jul. 1998, 12 pages.
Norma Italiana, Acoustics—Determination of sound absorption coefficient and impedance in impedances tubes, Transfer-function method, UNI EN ISO 10534-2, Oct. 2001, 36 pages.
Norma Italiana, Acoustics—Materials for acoustical applications—Determination of airflow resistance, UNI EN 29053, Feb. 1994, 16 pages.

* cited by examiner

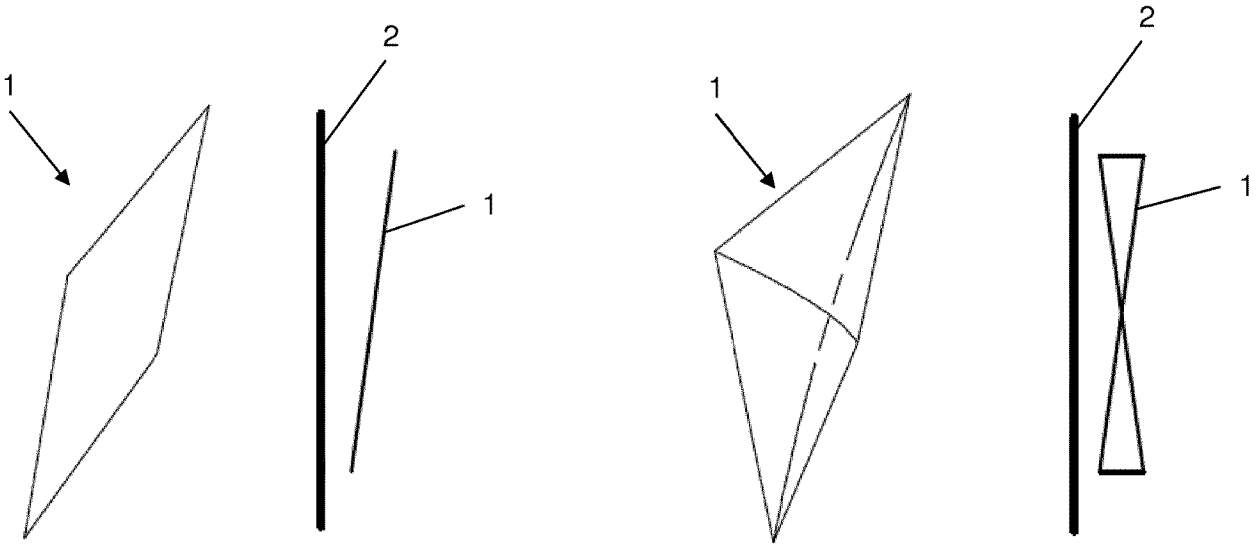
Fig. 3a
Fig. 3b
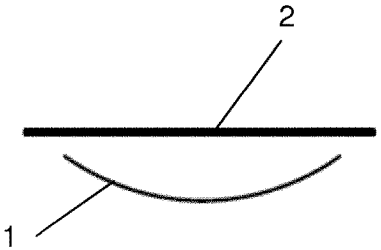
Fig. 3c

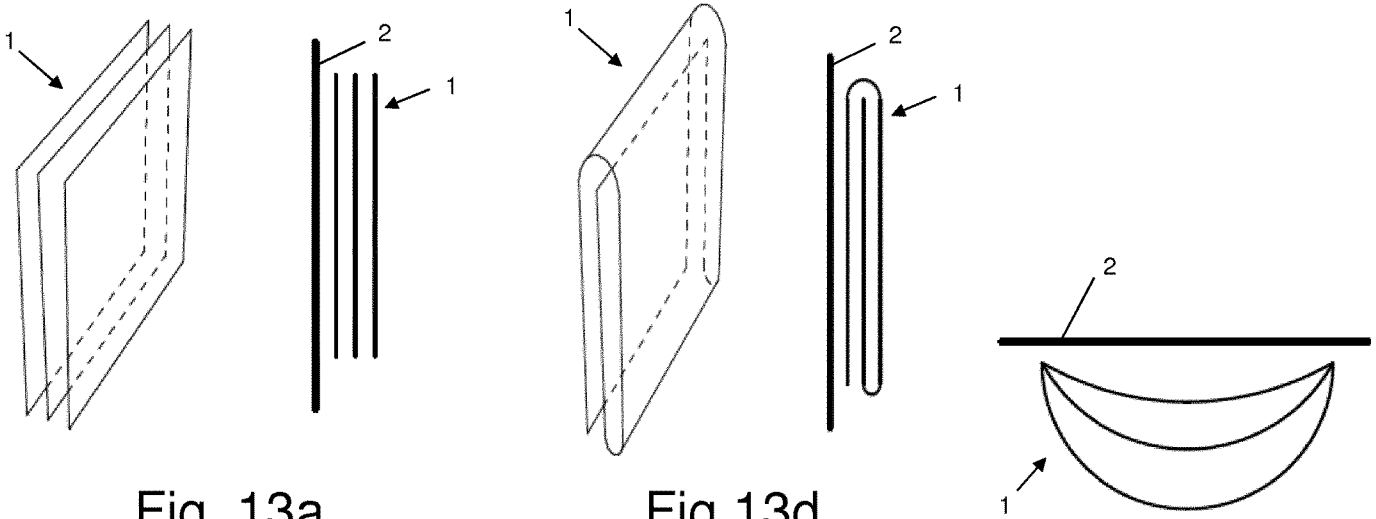
Fig. 13a
Fig.13d
Fig. 13e
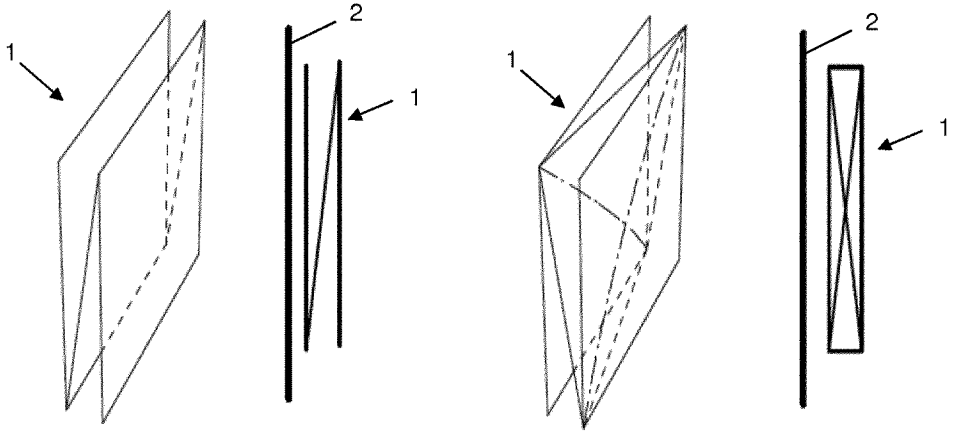
Fig. 13b
Fig. 13c

SOUND-ABSORBING ELEMENT AND SYSTEM

This application is the U.S. national phase of International Application No. PCT/EP2015/078528 filed Dec. 3, 2015 which designated the U.S. and claims priority to IT Patent Application No. MI2014A002092 filed Dec. 5, 2014, the entire contents of each of which are hereby incorporated by reference.

FIELD OF APPLICATION

The present invention relates to a sound-absorbing element and system.

PRIOR ART

It is known that when a sound wave emitted in a closed room encounters a surface, a part of its energy passes through the surface, a part is absorbed by the impact with the surface and a part is reflected into the room.

If in a room the amount of reflecting surface is high, the room may be acoustically very disturbed since the sound waves produced inside it are amplified with an effect similar to that of an echo.

In order to improve the acoustics in a room, without structural modifications, it is known to use sound-absorbing materials in the room, in particular next to the surfaces which bound the said room (such as the walls and/or ceiling). These sound-absorbing materials, as is known, have the property of absorbing at least part of the acoustic energy and reducing the reflected energy part.

WO 2013/113800, in the name of the Applicant, describes a sound-absorbing panel comprising a padding layer comprising thermo-bonded synthetic fibers where said padding layer has a first thickness. In at least one portion of said panel it has a variable density, greater in the region of its outer layer and lesser in the region of its inner layer.

EP 2,472,018 A1 describes a sound-absorbing system understood as being a wall element comprising at least two supports provided with micro-perforations and a further support without micro-perforations. The support without micro-perforations is not enclosed by the microperforated supports. The supports are superimposed.

The Applicant has noted that the system described in EP 2,472,018 A1 could disadvantageously be complex and costly to produce. In the system in fact at least two supports are micro-perforated and the micro-perforations are arranged in a regular manner on the surface of the support. Moreover, the size of each micro-perforation and the distance between one micro-perforation and the adjacent ones must be controlled in a precise manner. The performance of the sound-absorbing system of EP 2,472,018 A1 depends in fact in a critical manner on such geometric parameters. The production of the system according to EP 2,472,018 A1 is therefore critical and complex and involves relatively high costs for machining of the supports.

The object of the present invention is therefore to provide a sound-absorbing element which is less complex and costly to produce compared to the system according to EP 2,472,018 A1.

SUMMARY OF THE INVENTION

The inventor has conducted tests on various materials and has surprisingly discovered that a sound-absorbing element which is simpler and less costly than the system according to EP 2,472,018 A1 may be produced using a fibrous material, also with a single layer.

More particularly, the inventor has discovered that a sound-absorbing element which is simpler and less costly than the system according to EP 2,472,018 A1 may made using a natural or man-made fabric having certain properties in respect of its specific airflow resistance Rs and mass porosity PM, as will be discussed in detail hereinbelow.

The inventor has advantageously discovered that fibrous materials with a specific airflow resistance (which will be also indicated, simply, as Rs) lower than 414 Pa s/m or higher than 2368 Pa s/m, and a mass porosity (which will be also be indicated simply as PM) less than 60% or greater than 81% have a poor performance in terms of sound absorption; that fibrous materials with a specific airflow resistance of between 527 Pa s/m and 552 Pa s/m, and a mass porosity PM of between 66% and 79% have a good performance in terms of sound absorption; and that fibrous materials with a specific airflow resistance Rs of between 723 Pa s/m and 1213 Pa s/m, and a mass porosity PM of between 74% and 77% have an optimum performance in terms of sound absorption.

Based on these properties advantageously materials suitable for the sound-absorbing element according to the present invention may be identified. The present invention advantageously provides a sound-absorbing element and a sound-absorbing system which is simple and inexpensive to produce and has optimum sound-absorbing characteristics.

According to a first aspect the present invention provides a sound-absorbing element comprising a fibrous material having the following properties:

- a specific airflow resistance comprised between 527 and 1552 [Pa s/m]; and
- a mass porosity comprised between 66% and 79%.

Preferably the fabric has a specific airflow resistance comprised between 723 and 1213 [Pa s/m] and a mass porosity comprised between 74% and 77%.

Preferably, the fibrous material comprises a fabric.

More preferably, the fabric is an artificial fabric.

Preferably, the warp of the fabric comprises a number of yarns per centimeter comprised between 5 and 70.

More preferably, the warp of the fabric comprises a number of yarns per centimeter comprised between 5 and 40.

Even more preferably, the warp of the fabric comprises a number of yarns per centimeter comprised between 15 and 40.

Preferably, the weft of the fabric comprises a number of yarns per centimeter comprised between 5 and 70.

More preferably, the weft of said fabric comprises a number of yarns per centimeter comprised between 5 and 40.

Even more preferably, the weft of said fabric comprises a number of yarns per centimeter comprised between 12 and 22.

According to some embodiments of the present invention, the sound-absorbing element comprises one or more layers of the fabric.

According to a first aspect, the present invention provides a sound-absorbing system comprising a sound-absorbing element as mentioned above, and a surface cooperating with the sound-absorbing element.

Preferably, the surface is at a given distance from at least one portion of the sound-absorbing element.

Preferably, this distance is comprised between about 1 cm and about 30 cm.

BRIEF DESCRIPTION OF THE DRAWINGS

The present invention will become clearer in the light of the following detailed description, provided by way of a non-limiting example, to be read with reference to the accompanying drawings in which:

FIGS. 3*a*, 3*b* and 3*c* show other embodiments of single-layer sound-absorbing elements and systems according to the present invention;

FIGS. 13*a*-13*e* show other embodiments of triple-layer sound-absorbing elements and sound-absorbing systems according to the present invention.

DETAILED DESCRIPTION

For the purposes of the present invention and the claims it must be understood that, except where otherwise indicated, all the numbers which express values, quantities, percentages and the like must be interpreted as though they were preceded, in each case, by the term "about". Moreover, all the ranges include every combination of the limit values of the range indicated and include all the sub-intervals, which may also be not specifically mentioned in the present invention.

The present invention relates to a sound-absorbing element comprising a fibrous material designed to cooperate with a surface by means of an air gap, so as to absorb at least part of the energy of a sound wave emitted in the environment. A "sound-absorbing system" according to the present invention comprises the sound-absorbing element and the surface with which it cooperates.

The verb "cooperate" is understood as meaning that, when the sound-absorbing element 1 is struck by a sound wave, the surface 2 receives and at least party reflects (towards the sound-absorbing element) part of the energy associated with the sound wave which strikes the sound-absorbing element 1.

In greater detail, it is known that when the sound wave reaches the sound-absorbing element 1, part of its energy is reflected and part is transmitted. The transmitted energy is attenuated owing to the properties of the material of the sound-absorbing element 1 (in particular, if the sound-absorbing element 1 comprises a fabric, the latter attenuates the sound wave transmitted owing to its specific airflow resistance Rs and its porosity). The sound wave transmitted through the sound-absorbing element 1 strikes the surface 2 and is reflected by it. The absorption of the energy of the sound wave which strikes the sound-absorbing element 1 therefore occurs as a result of attenuation of the energy of the sound wave due to the material of the sound-absorbing element 1 and as a result of abatement of the waves transmitted and reflected in the air gap between the element 1 and the surface 2. In particular, the absorption occurs for any frequency, but is more intense for some (equally spaced) frequencies which, in the case where the surface 2 is perfectly rigid and reflecting, depend essentially on the thickness of the air gap. In the case of normal incidence of the sound wave on the surface 2, the first maximum absorption frequency is that for which the thickness of the air gap is equal to ¼ of the length of the wavelength of the sound wave.

With reference to FIGS. 1, 2 and 3*a*-3*c*, first embodiments of the present invention relate to a sound-absorbing element 1 comprising a single layer of a fibrous material.

Figure 1:
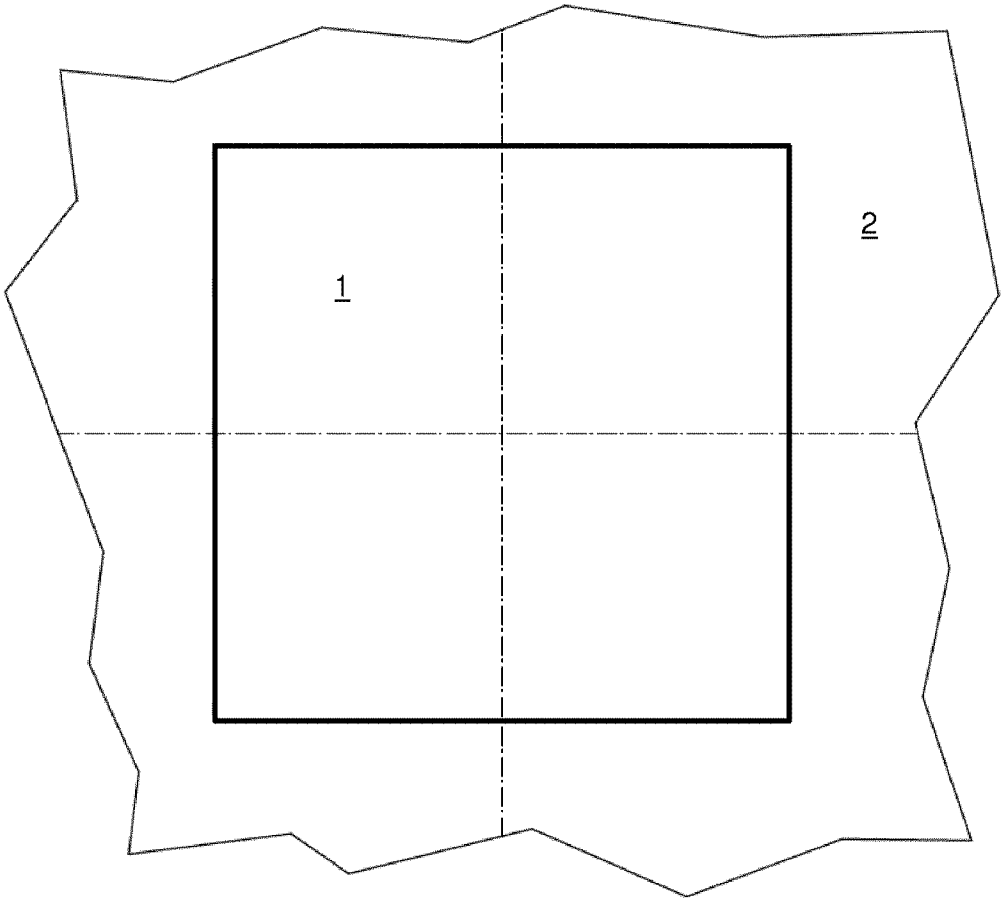
FIG. 1 shows a sound-absorbing element with a single layer of fibrous material according to an embodiment of the present invention, cooperating with a surface.
Figure 2:
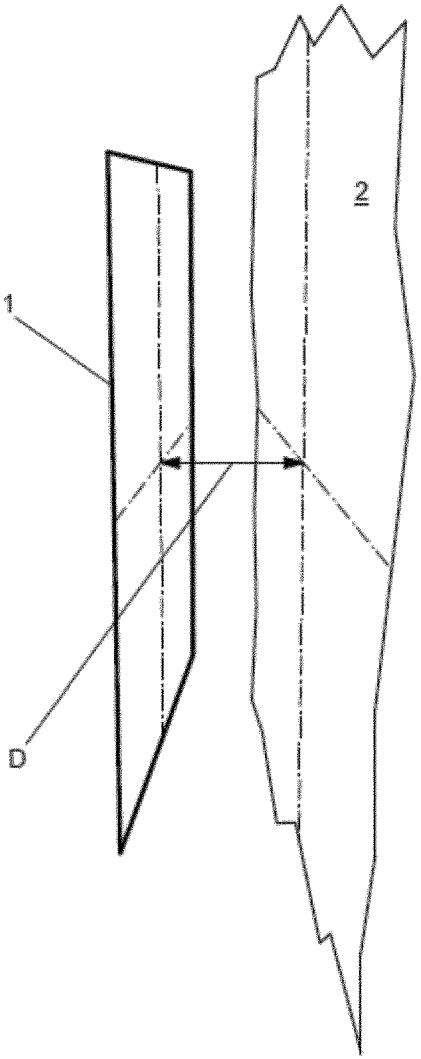
FIG. 2 is a side view of the sound-absorbing element and the surface of FIG. 1.

In particular, in the embodiment shown by way of example in FIGS. 1 and 2, the sound-absorbing element 1 is in the form of a flat panel. This embodiment is provided purely by way of example. The sound-absorbing element 1 according to the present invention may in fact have any form.

The sound-absorbing element 1 shown in FIGS. 1 and 2 cooperates with a surface 2. According to an embodiment (shown in FIGS. 1 and 2), the surface 2 is a substantially flat surface. In other embodiments, the surface may not be flat, but has undulations, reliefs, angled walls, etc. Preferably, the sound-absorbing element 1 is located at a distance D from the surface 2. The distance between the element 1 and the surface 2 may also not be uniform. For example, the element 1 may be inclined with respect to the surface 2. According to one embodiment, the element 1 may be attached to the surface 2.

Therefore the expression according to which the sound-absorbing element is located at a distance D from the surface 2 means that at least a portion of the element 1 is located at a distance D from the surface 2 ("D" being constant or variable).

The surface 2 may for example be a wall or ceiling of the room in which the sound-absorbing element 1 is positioned, a rigid panel or an impermeable material. The distance D may be variable from a minimum of a few centimeters (e.g. 1-5 cm) to a maximum of 20 cm or more (also more than 30 cm).

FIGS. 3*a* and 3*b* show, by way of example, two adjacent views (axonometric view on the left and side view on the right) of other two possible embodiments of the single-layer sound-absorbing element 1 in which the distance between the element 1 and the surface 2 is not uniform. In particular, in FIG. 3*a* the element 1 is inclined with respect to the surface 2 and in FIG. 3*b* the element 1 is helix-shaped. FIG. 3*c* is a side view of a further embodiment of the sound-absorbing element 1 in which said element 1 cooperates with a horizontal surface 2 of a room, for example the ceiling.

Hereinbelow, the tests carried out by the inventor which resulted in the identification of the properties of the fibrous material for the sound-absorbing element 1 according to the present invention are described.

The inventor firstly selected a set of different fibrous materials for the aforementioned tests. This set comprises a number of materials equal to 31, which below will be indicated by means of the reference symbols M(1), M(2), . . . , M(31) or M(i), i=1, . . . , 31. Said materials are artificial fabrics which are made of polyester Trevira CS® and which vary from each other as regards one or more of the following properties: thickness, porosity, weave, number of weft yarns, number of warp yarns, treatment of the yarn, number of filaments.

Tables 1-3 show some properties of some of the materials considered. Table 1 shows the type of weave, Table 2 the characteristics of the warp and Table 3 the characteristics of the weft of the materials considered.

As can be seen from the Tables, each material considered may be composed of a single type of yarn (yarn 1, indicated also as "yrn 1 ") or two types of yarn (yarn 1 and yarn 2, indicated also as "yrn 2"), both along the weft and along the warp). A yarn is composed of a set of filaments which are bound together to form a thread. In the columns "yarn 1" and "yarn 2" of Tables 2 and 3 the numbers in brackets indicate the number of threads of the respective yarn.

In Tables 2 and 3, the abbreviation "Dtex" refers to the unit of measurement "decitex" for the linear density of the yarn, which represents in grammes the weight of 10 km of yarn.

The term "texturized" indicates that the yarn has undergone a texturization procedure which, as is known, is a process involving processing of the yarn by means of a thermo-mechanical treatment which stabilizes shrinkage of the fibers after being spun-extruded.

The term "taslanized" indicates that the yarn has undergone a taslanization procedure which, as is known, is a treatment process using a high-pressure air jet.

The term "twisted" indicates that the yarn is formed by threads which are joined and twisted together in pairs.

A "cationic" yarn (typically a polyester) is, as is known, a yarn composed of modified-polyester threads which can be dyed at the boiling temperature using cationic or basic dyes.

TABLE 1

| Material | Weave |
|---|---|
| M(1) | mixed |
| M(2) | mixed |
| M(3) | mixed |
| M(4) | crêpe |
| M(5) | matt |
| M(6) | twill |
| M(7) | cloth |
| M(8) | mixed |
| M(9) | mixed |
| M(10) | mixed |
| M(11) | cloth |
| M(12) | cloth |
| M(13) | cloth |
| M(14) | mixed |
| M(15) | mixed |
| M(16) | mixed |
| M(17) | mixed |
| M(18) | mixed |
| M(19) | mixed |
| M(20) | mixed |
| M(21) | Crêpe |
| M(22) | Crêpe |
| M(23) | Crêpe |
| M(24) | Crêpe |
| M(25) | crêpe |
| M(26) | mixed |
| M(27) | mixed |
| M(28) | mixed |
| M(29) | mixed |
| M(30) | mixed |
| M(31) | mixed |

TABLE 2

| Material | Warp [threads/cm] | Yarn 1 | Dtex yrn 1 | Filaments yrn 1 | Yarn 2 | Dtex yrn 2 | Filaments yrn 2 |
|---|---|---|---|---|---|---|---|
| M(1)-M(3) | 19 | (7.6) texturized interlaced | 668 | 128 | (11.4) taslanized glossy | 1400 | 256 |
| M(4) | 19 | texturized interlaced | 668 | 128 | | | |
| M(5) | 18 | taslanized 25% cationic | 850 | 228 | | | |
| M(6) | 26 | texturized twisted | 330 | 128 | | | |
| M(7) | 9.5 | taslanized | 1340 | 320 | | | |
| M(8)-M(10), M(14)-M(27) | 19 | taslanized | 850 | 256 | | | |
| M(11) | 35 | texturized twisted | 330 | 128 | | | |
| M(12) | 5.5 | twisted | 4830 | 768 | | | |
| M(13) | 67 | | 167 | 32 | | | |
| M(28)-M(31) | 19 | (7.6) texturized interlaced | 668 | 128 | (11.4) taslanized glossy | 1400 | 256 |

TABLE 3

| Material | Weft [threads/cm] | Yarn 1 | Dtex yrn 1 | Filaments yrn 1 | Yarn 2 | Dtex yrn 2 | Filaments yrn 2 |
|---|---|---|---|---|---|---|---|
| M(1) | 14.63 | (7.315) texturized interlaced | 668 | 128 | (7.315) taslanized glossy | 1400 | 256 |
| M(2) | 14.25 | (7.125) texturized interlaced | 668 | 128 | (7.125) taslanized glossy | 1400 | 256 |
| M(3) | 13.5 | (6.75) texturized interlaced | 668 | 128 | (6.75) taslanized glossy | 1400 | |
| M(4) | 19 | texturized interlaced | 668 | 128 | | | |
| M(5) | 18 | taslanized 25% cationic | 850 | 228 | | | |
| M(6) | 21 | texturized | 668 | 1024 | | | |
| M(7) | 10 | taslanized | 1340 | 320 | | | |
| M(8), M(14) | 9.6 | (3.2) taslanized | 850 | 256 | (6.4) taslanized | 4000 | 1152 |
| M(9), M(16) | 11.4 | (3.8) taslanized | 850 | 256 | (7.6) taslanized | 4000 | 1152 |
| M(10), M(20) | 13.2 | (4.4) taslanized | 850 | 256 | (8.8) taslanized | 4000 | 1152 |
| M(11) | 12 | taslanized | 850 | 512 | | | |
| M(12) | 5.5 | twisted | 4830 | 768 | | | |
| M(13) | 11 | taslanized | 850 | 256 | | | |
| M(15) | 10.8 | (3.6) taslanized | 850 | 256 | (7.2) taslanized | 4000 | 1152 |
| M(17) | 11.7 | (3.9) taslanized | 850 | 256 | (7.8) taslanized | 4000 | 1152 |
| M(18) | 12.3 | (4.1) taslanized | 850 | 256 | (8.2) taslanized | 4000 | 1152 |
| M(19) | 12.6 | (4.2) taslanized | 850 | 256 | (8.4) taslanized | 4000 | 1152 |
| M(21) | 12 | (6) taslanized | 850 | 256 | (6) taslanized | 4000 | 1152 |
| M(22) | 12.3 | (6.15) taslanized | 850 | 256 | (6.15) taslanized | 4000 | 1152 |
| M(23) | 12.6 | (6.3) taslanized | 850 | 256 | (6.3) taslanized | 4000 | 1152 |
| M(24) | 13.2 | (6.6) taslanized | 850 | 256 | (6.6) taslanized | 4000 | 1152 |
| M(25) | 14.4 | (7.2) taslanized | 850 | 256 | (7.2) taslanized | 4000 | 1152 |
| M(26) | 11 | (5.5) taslanized | 850 | 256 | (5.5) taslanized | 4000 | 1152 |
| M(27) | 12 | (6) taslanized | 850 | 256 | (6) taslanized | 4000 | 1152 |
| M(28)-M(31) | 15 | (7.5) texturized interlaced | 668 | 128 | (7.5) taslanized glossy | 1400 | 256 |

The inventor also defined an absorption parameter indicative of the sound-absorbing performance of the materials considered. This parameter was defined as described below.

Each material considered was subjected to a testing activity after being arranged in a vertical position substantially parallel to a flat surfaces separated therefrom by an air gap (as in FIG. 1).

The materials considered, in particularly a subset thereof comprising 20 materials, in the case in question the materials M(i) where $i \in I = \{1\text{-}13, 21, 24\text{-}29\}$, were tested in a test room having a volume of about 20 $m^3$ with measurements carried out according to the UNI standard EN ISO 354:2003 dated 1 Dec. 2003 "Acoustics—Measurement of the sound absorption in a reverberation chamber", in keeping with the volume and characteristics of the test room. For each material, the diffuse incidence absorption coefficient was measured considering three different air gaps (D=50 mm, 100 mm, 200 mm). For each material and for each gap, the diffuse incidence absorption coefficient was measured at 6 fixed points in the test room and the values thus obtained were then averaged. The measurement of the diffused incidence absorption coefficient was carried out in bands of about ⅓rd of an octave inside a frequency range of between 250 Hz and 6300 Hz.

For each material and each air gap, in the range of frequencies considered, the inventor obtained a number N=15 of diffuse incidence absorption coefficient values (in particular, as mentioned above, each of these values was obtained from an average of 6 measurements). The diffuse incidence absorption coefficient values thus obtained, for the material M(i), $i \in I = \{1\text{-}13, 21, 24\text{-}29\}$, will be indicated below by the notation C(i, j, k), where the index j=1, . . . , N indicates the value of the diffuse absorption coefficient at a given frequency and the index k indicates the thickness value of the air gap considered for each measurement (for example, k=1 indicates D=50 mm, k=2 indicates D=100 mm and k=3 indicates D=200 mm).

Thereafter, for each material and for each thickness value of the air gap, the average Cm(i, k), $i \in I$, k=1, 2, 3 of the absorption coefficient value C(i, j, k), i∈I, j=1, . . . , N, k=1, 2, 3, in the frequency range considered, was calculated using the following formula:

$$Cm(i,k)=\sum_{j=1}^{N}\frac{C(i,j,k)}{N}. \quad [1]$$

In this way, an average value of the diffuse incidence absorption coefficient Cm(i,k) was associated with each material M(i), i∈I, for each thickness of the air gap.

Finally, for each material M(i), i∈I, the average values of the diffuse incidence absorption coefficient Cm(i,k) relating to the three air gap thicknesses considered was further averaged in order to obtain a parameter indicative of the "average" absorption properties of each material. This parameter will be indicated below simply as "absorption parameter" and using the notation CM(i). For each material M(i), the corresponding absorption parameter CM(i) is calculated using the following formula:

$$CM(i)=\sum_{k=1}^{3}\frac{C(i,k)}{3}. \quad [2]$$

Figure 4:
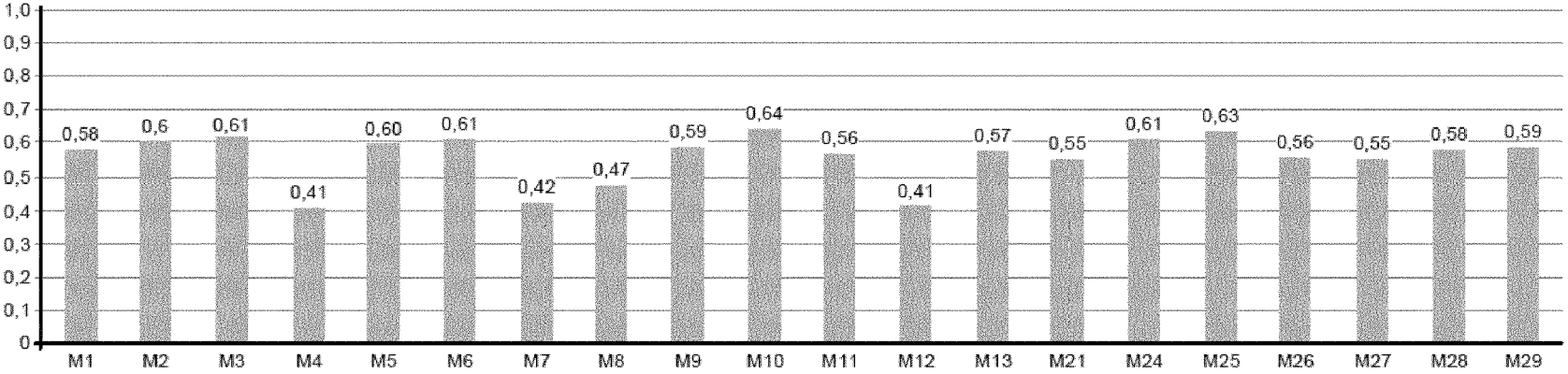
FIG. 4 is a histogram which shows the values of an absorption parameter indicative of the absorption property of a set of materials considered during the tests.

FIG. 4 is a histogram which shows the values of the absorption parameter CM(i) for the 20 materials M(i), i∈I considered by the inventor for evaluation of the absorption parameter. As can be seen from FIG. 4, the materials M(3), M(6), M(10), M(24) and M(25) have the highest absorption parameter values (higher than 0.6). On the other hand, the materials M(4), M(7) and M(12) have the lowest absorption parameter values (lower than 0.45).

By way of confirmation of the results described above, the inventor carried a number of tests at the Certification Institute "Istituto Giordano", situated in Gatteo (FC, Italy) in a reverberation chamber certified in accordance with the UNI standard EN ISO 354:2003 already mentioned above. In particular, the inventor carried a number of tests considering the materials M(4), M(11), M(12), M(20) and M(25).

Figure 5:
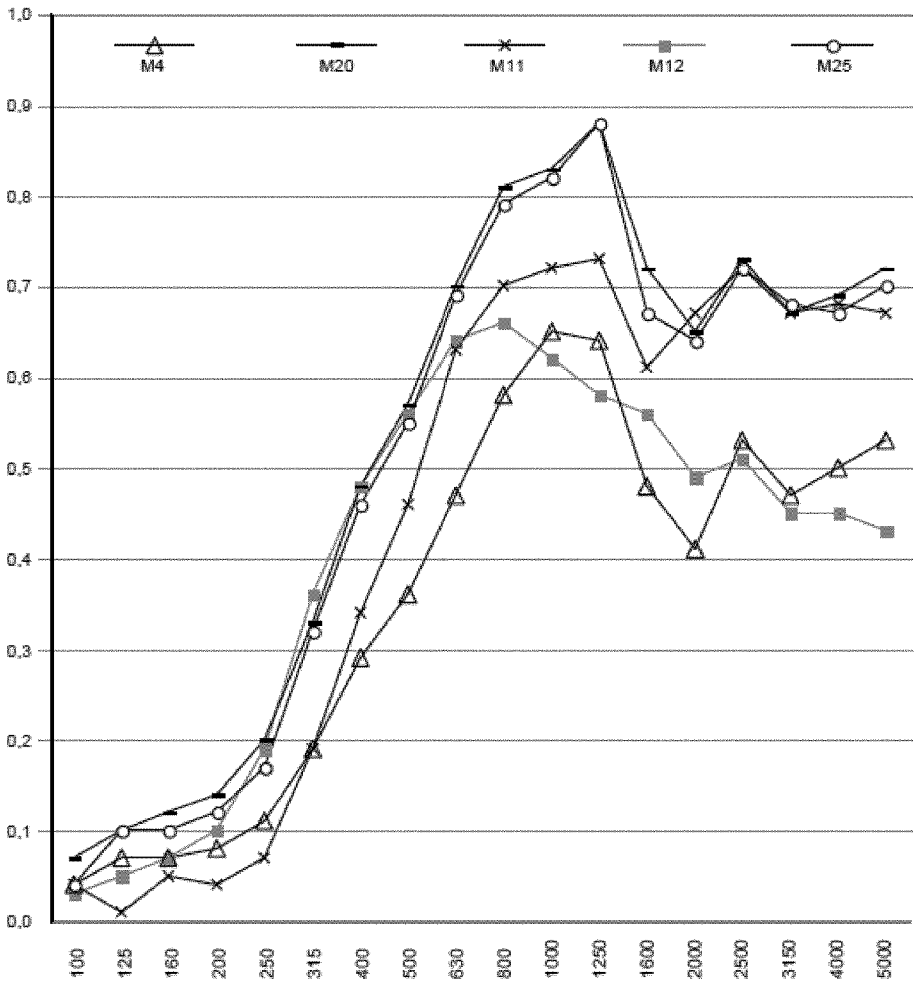
FIG. 5 is a graph which shows the diffuse incidence absorption coefficient values measured for some of the materials considered at a Certification Institute.

The results of these tests carried out in accordance with the UNI standard EN ISO 354:2003 are shown in FIG. 5. In particular, FIG. 5 shows the graphs of the diffuse incidence absorption coefficient (along the y axis) for the fabrics M(4), M(11), M(12), M(20) and M(25) as a function of the frequency (along the x axis), considering an air gap between the fabric and a flat surface (a wall of the reverberation chamber) of about 100 mm. The frequency is expressed in Hz. The results indicate the good reliability of the measurements obtained in the test room and described above, the histogram shown in FIG. 4 being based on said measurements. Moreover, the results show that the fabrics M(12) (with an absorption parameter CM(12)=0.44) and M(4) (having an absorption parameter CM(4)=0.41), effectively have an absorption less than that of the fabric M(25) (which has an absorption parameter CM(25)=0.63) and the fabric M(20), while the fabric M(11) (having an absorption parameter CM(11)=0.56) confirms its intermediate result compared to the other fabrics M(12), M(4), M(20) and M(25).

On the basis of the results obtained, below in the present description and the claims, the expression "poor performance", relating to the sound-absorbing properties of a material, will be understood as meaning that the material has an absorption parameter of less than 0.5; the expression "good performance", relating to sound-absorbing properties of a material, will be understood as meaning that the material has an absorption parameter of between 0.5 and 0.6; the expression "optimum performance", relating to sound-absorbing properties of a material, will be understood as meaning that the material has an absorption parameter higher than 0.6.

As known (see the UNI standard EN 29053-1994 "Acoustics. Materials for acoustic applications. Determination of the airflow resistance"), the specific airflow resistance Rs of a material quantifies the acoustic energy dissipation properties within the material and is defined as:

$$Rs=\frac{\Delta P}{qv}\cdot A \ \ [\mathrm{Pa\cdot s/m}] \quad [3]$$

where ΔP [Pa] is the pressure difference between the two sides of the material compared to the atmosphere, qv [$m^3/s$] is the flowrate of the air which passes through the material and A [$m^2$] is the cross-section of the material perpendicular to the direction of the air flow.

For each specific material tested M(i), i=1, . . . , 31, its specific airflow resistance Rs(i) was estimated using the following procedure:

a) a layer of material M(i) was glued onto a ring of plastic material (polycarbonate) with an outer diameter of 45 mm and positioned inside a Kundt's tube (called also a flat-wave tube or impedance tube) comprising two microphones, at a distance of about 100 mm from the end of the tube;

b) an apparent sound absorption coefficient for normal incidence in the frequency range of between 100 Hz and 4200 Hz was determined in accordance with the UNI standard ISO 10534-2:2001 "Acoustics—Determination of the sound absorption coefficient and the acoustic impedance in impedance tubes—Transfer function method"; this coefficient will be indicated below with the notation C'(i, j), in which, assuming that in the frequency range considered M values of the normal incidence absorption coefficient (for example equally spaced in terms of frequency, with an interval of about 10 Hz) are obtained, the index j=1, . . . , M indicates the value of said absorption coefficient at a given frequency;

c) for each apparent sound absorption coefficient for normal incidence measured C'(i,j), a respective theoretical coefficient Cth'(i,j) was determined, being obtained as follows:

$$Cth'(i,j)=\frac{4\cdot \mathrm{Re}\{\zeta s\}}{|\zeta s|^2+2\cdot \mathrm{Re}\{\zeta s\}+1} \quad [4]$$

wherein:

$$\zeta s=\frac{1}{\rho_0 c_0}[Rs(i)+i\cdot(\omega\cdot Ms(i)-\rho_0 c_0\cdot \cot(k_0\cdot d))] \quad [5]$$

where the notation Re{•} indicates the real part of a complex value and the notation |•| indicates the module of a complex value, Rs(i) is the specific airflow resistance of the material M(i), Ms(i) [$kg/m^2$] is the acoustic mass of the material, ω [rad/s] is the angular frequency, $\rho_0$ [$kg/m^3$] is the air density, $c_0$ [m/s] is the speed of sound in the air and d [m] is the thickness of the air gap between the material M(i) and the end of the tube;

d) for each given material M(i) the specific airflow resistance value Rs(i) and the acoustic mass value were determined, these minimizing the following expression:

$$\sum_{j=1}^{M} |C'(i, j) - Cth'(i, j)| \quad [6]$$

where C'(i,j), as mentioned, is the apparent sound absorption coefficient for normal incidence measured, Cth'(i,j) is the respective theoretical coefficient and M is the number of absorption coefficient values for normal incidence in the frequency range considered;

e) the specific resistance value thus determined is divided by a corrective factor equal to about 1.15 which takes account of the presence of the ring of plastic material used during the measurements of the apparent sound absorption coefficient for normal incidence in the Kundt's tube performed during step a) described above.

At the end of step e) a specific resistance value Rs(i) for each of the materials M(i) considered is then determined.

The measurement system comprises the Kundt's tube with a diameter of 45 mm, two pressure microphones with a nominal diameter of ¼" made by PCB Piezotronics Inc., model 378C10, a National Instruments™ USB 4431 board and a power amplifier commercially distributed by B.I.G. S.r.l. (San Marino) model NGS 1A.

Figure 6:
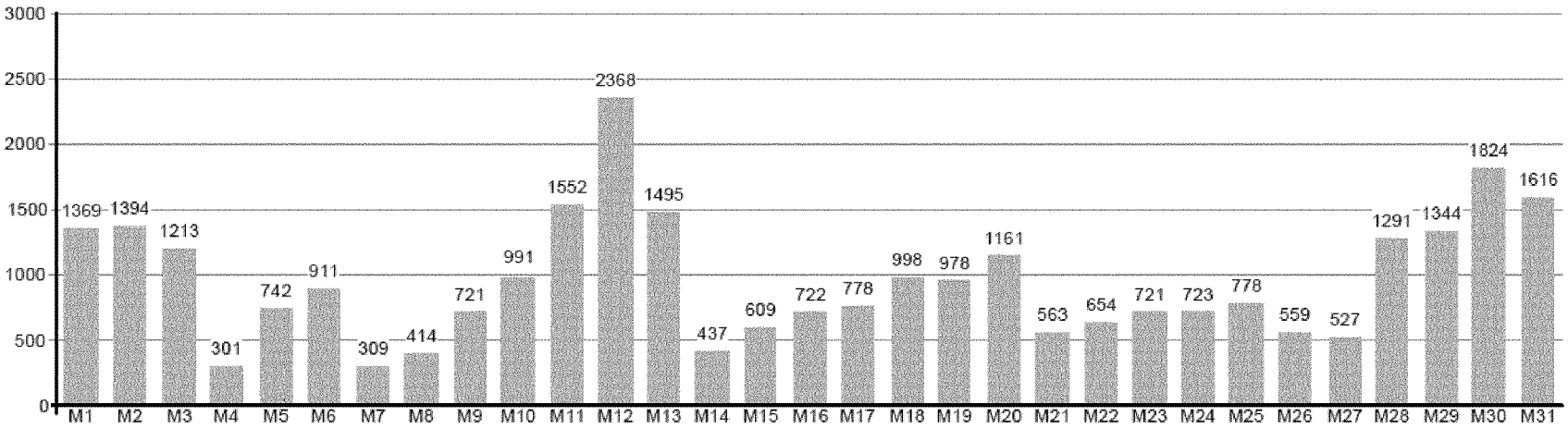
FIG. 6 is a histogram which shows the specific airflow resistance values Rs for the tested materials.

FIG. 6 is a graph showing the specific airflow resistance values Rs(i), i=1, . . . , 31, for the materials considered. As can be seen from the graph shown in FIG. 6, the inventor discovered that the materials tested M(i) have a specific airflow resistance value Rs(i) of between 301 Pa·s/m and 2368 Pa·s/m.

Figure 7:
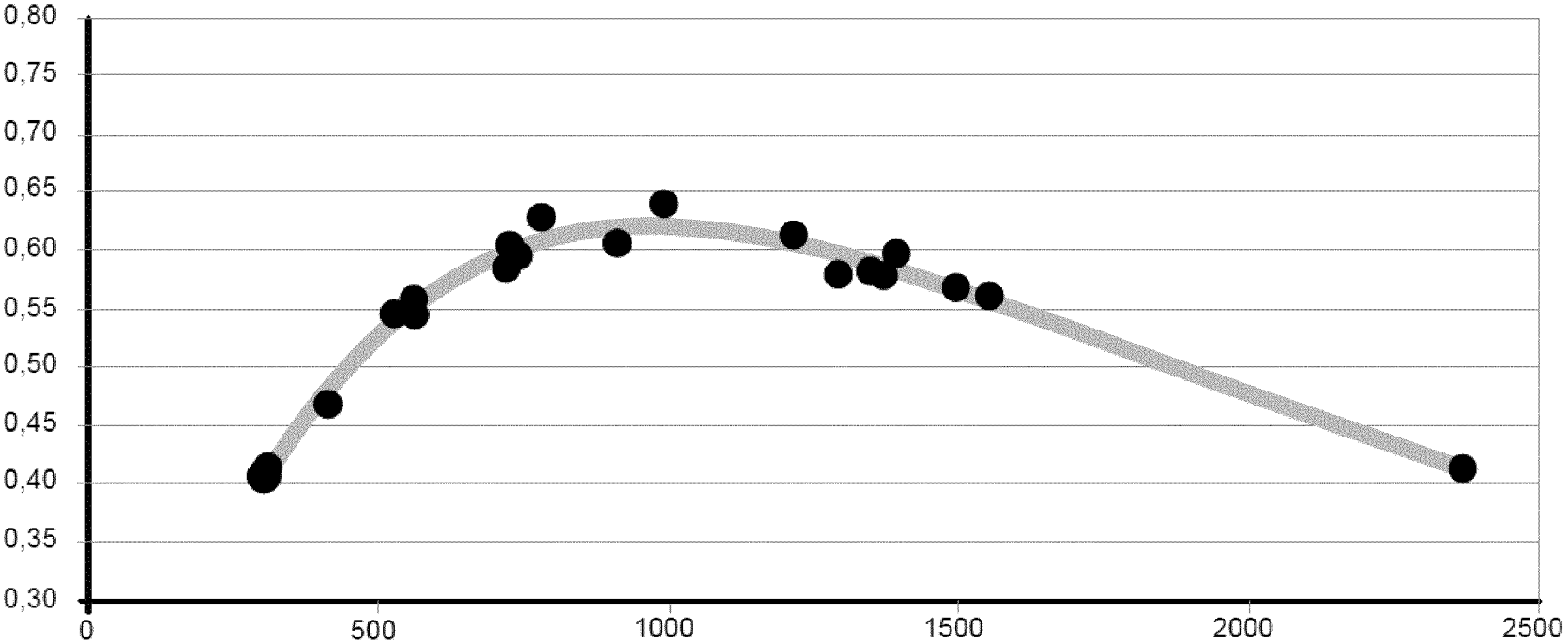
FIG. 7 is a graph which shows the values of the absorption parameter as a function of the specific airflow resistance.

Based on the values of the absorption parameter CM(i) shown in FIG. 4 and the values of the specific airflow resistance Rs(i) shown in FIG. 6, the inventor determined the trend for the absorption parameter as a function of the specific airflow resistance values for the materials considered. FIG. 7 shows the graph for the absorption parameter values (along the y axis) as a function of the specific airflow resistance (along the x axis). The unit of measurement of the specific airflow resistance Rs(i) is Pa·s/m. As can be seen from the graph shown in FIG. 7, the inventor discovered that the greater values of the absorption parameter are obtained for specific airflow resistance values comprised between 700 Pa·s/m and 1400 Pa·s/m.

As is known, the mass porosity PM of a material defines the percentage of air interconnected within a given apparent volume. The mass porosity PM is determined by the following formula:

$$PM = 1 - \frac{\rho}{\rho_{rif}} \quad [7]$$

where ρ is the apparent density of the material and $\rho_{rif}$ is the density of a reference material, namely a material which forms the structure of said material. If, for example, the reference material is the material Trevira®, which is commercially available, its density $\rho_{rif}$ is equal to about 1.38 g/cm$^3$.

The inventor determined the apparent density ρ(i) of each material tested M(i), i=1, . . . , 31, calculating the ratio between the surface mass of the material, namely the mass for 1 m$^2$ of material, and the corresponding thickness. Both these parameters were measured during tests.

In order to measure the surface mass of the material M(i), the inventor considered a sample of the material M(i), recorded its area and measured its weight using precision scales. Carrying out suitable conversions, based on the data relating to the reference material mentioned above with a density of about 1.38 g/cm$^3$, the inventor obtained the surface mass of the material. It should be noted that the calculations and the conversions described hereinabove are based on the theoretical data of the density of the material Trevira® equal to 1.38 g/cm$^3$ and that, in the event of use of additives or different materials, this value could be different. For example, the use of an additive based on silver ions makes the fabric bacteriostatic and would increase the density to about 1.4 g/cm$^3$. In this case, the calculations should re-parameterized depending on the new value.

Moreover, in order to measure the thickness of the material M(i), the inventor used a thickness gauge D-2000-T commercially distributed by the company Soraco in Biella (Italy), adopting the procedure described in the UNI standard EN ISO 5084 under points 8.1, 8.2, 8.3 and 8.4. In particular, a 20 cm$^2$ presser with a pressure of 1.0 kPa was used and the arithmetic mean of 5 measurements recorded at a temperature of between 20 and 22° C. with an air moisture of 45-50%, considered admissible for the minimum moisture absorption of the polyester (maximum of about 1.5%) declared by the manufacturers, was calculated.

Table 4 shows the values measured for surface mass, thickness and apparent density ρ(i) of the materials M(i) considered.

TABLE 4

| Material | Surface mass [gr/m$^2$] | Thickness [mm] | ρ(i) [kg/m$^3$] |
|---|---|---|---|
| M(1) | 444 | 1.18 | 376 |
| M(2) | 443 | 1 | 374 |
| M(3) | 431 | 1.19 | 362 |
| M(4) | 285 | 1.094 | 260 |
| M(5) | 400 | 1.3 | 308 |
| M(6) | 249 | 0.762 | 327 |
| M(7) | 287 | 1.166 | 246 |
| M(8) | 496 | 1.85 | 268 |
| M(9) | 556 | 1.84 | 302 |
| M(10) | 604 | 1.814 | 333 |
| M(11) | 230 | 0.574 | 401 |
| M(12) | 553 | 0.994 | 556 |
| M(13) | 245 | 0.522 | 470 |
| M(14) | 493 | 1.798 | 274 |
| M(15) | 526 | 1.784 | 295 |
| M(16) | 543 | 1.776 | 306 |
| M(17) | 554 | 1.756 | 316 |
| M(18) | 571 | 1.75 | 326 |
| M(19) | 574 | 1.756 | 327 |
| M(20) | 605 | 1.774 | 341 |
| M(21) | 473 | 1.552 | 305 |
| M(22) | 484 | 1.586 | 305 |
| M(23) | 491 | 1.566 | 314 |
| M(24) | 502 | 1.552 | 323 |
| M(25) | 532 | 1.552 | 343 |
| M(26) | 466 | 1.548 | 301 |
| M(27) | 509 | 1.748 | 291 |
| M(28) | 430 | 0.952 | 451 |
| M(29) | 432 | 1.008 | 428 |
| M(30) | 430 | 0.952 | 451 |
| M(31) | 432 | 1.008 | 428 |

Figure 8:
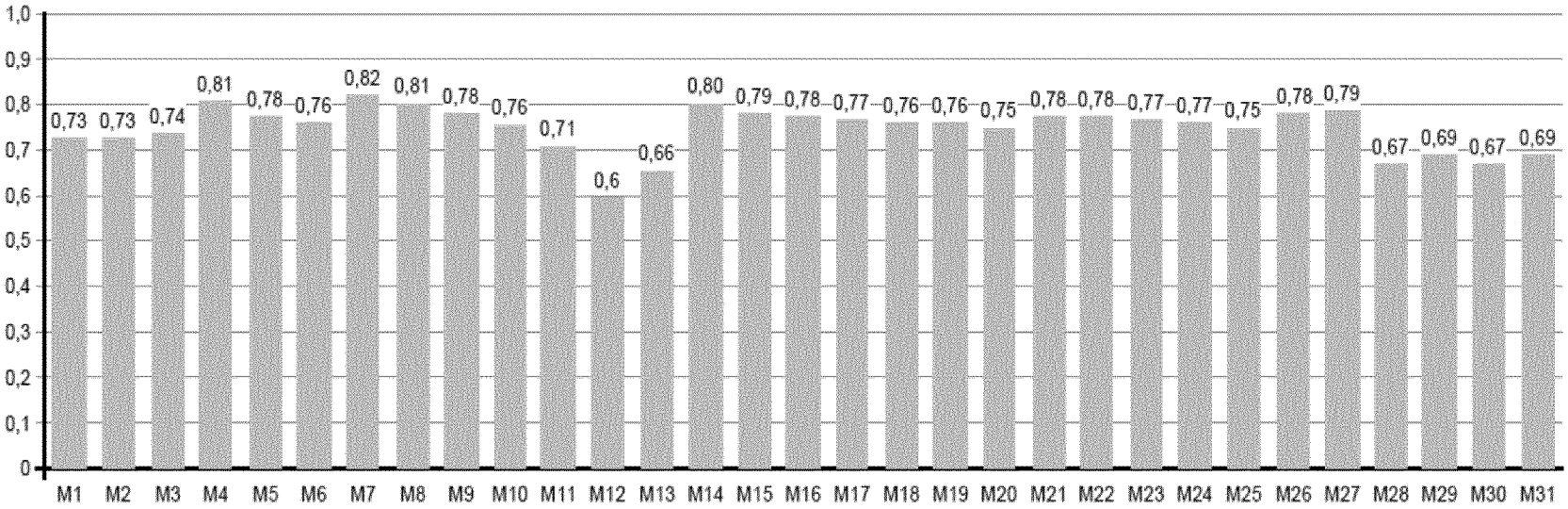
FIG. 8 is a histogram which shows the mass porosity values PM for the tested materials.

FIG. 8 shows instead the mass porosity values PM(i), i=1, . . . , 31, of the materials M(i) calculated using the formula [7] indicated above.

Figure 9:
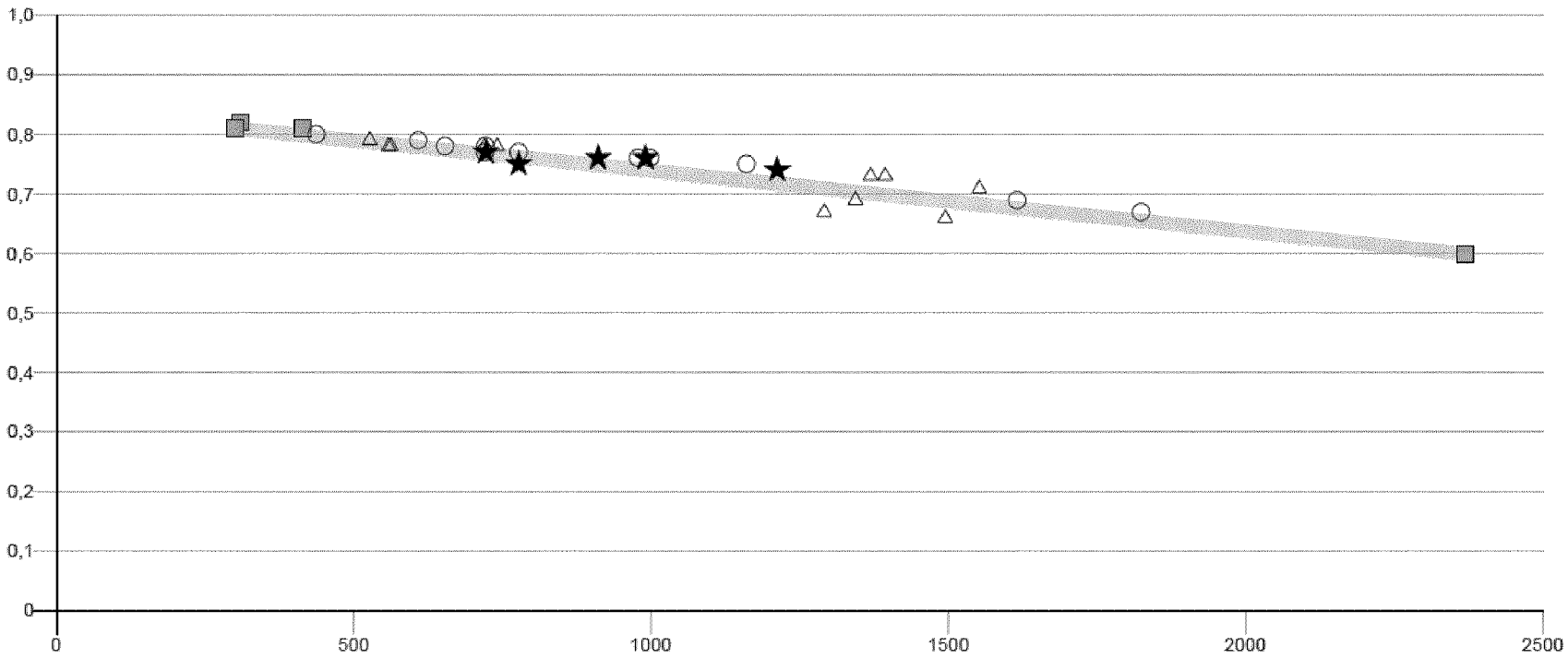
FIG. 9 is a graph which shows the mass porosity values as a function of the specific airflow resistance and correlated with the values of the absorption parameter.

Based on the values of the specific airflow resistance Rs(i) shown in FIG. 6 and the values of the mass porosity PM(i) shown in FIG. 8, the inventor determined the trend for the mass porosity as a function of the specific airflow resistance values of the materials considered. FIG. 9 shows the graph for the values of mass porosity PM(i) (along the y axis) as a function of the specific airflow resistance Rs(i) (along the x axis). The unit of measurement of the specific airflow resistance Rs(i) is Pa·s/m.

The inventor grouped together the values of the mass porosity PM(i) and specific airflow resistance Rs(i) for the materials tested M(i), i=1, . . . , 31, depending on the corresponding values of the absorption parameter CM(i). In particular, in FIG. 9, which shows the mass porosity values PM(i) as a function of the specific airflow resistance values Rs(i), each value is associated with a material M(i) and is represented by a respective graphical marker. The shape of the graphical marker associated with a material M(i) is indicative of the value of the absorption parameter CM(i) of the material M(i). The circular graphical markers indicate the materials for which the value of the absorption parameter CM(i) is not available (which value, as mentioned above, was obtained for a subgroup of 20 materials of the 31 materials tested).

The inventor discovered that:

materials, the absorption parameter of which is lower than 0.5, indicated by a square-shaped marker in FIG. 9, and which therefore have poor sound absorption properties, have a specific airflow resistance lower than 414 Pa·s/m or higher than 2368 Pa·s/m, and a mass porosity less than 60% or greater than 81%;

materials, the absorption parameter of which lies between 0.5 and 0.6, indicated by a triangular-shaped marker in FIG. 9, and which therefore have good sound absorption properties, have a specific airflow resistance comprised between 527 Pa·s/m and 1552 Pa·s/m, and a mass porosity comprised between 66% and 79%;

materials, the absorption parameter of which is higher than 0.6, indicated by a star-shaped marker in FIG. 9, and which therefore have excellent sound absorption properties, have a specific airflow resistance of between 723 Pa·s/m and 1213 Pa·s/m, and a mass porosity of between 74% and 77%.

To conclude, therefore, the inventor discovered that, based on the mass porosity PM and the specific airflow resistance Rs of the material, it is possible to predict the performance of said material in terms of sound absorption. If, for example, the material has a specific resistance Rs of about 900 Pa·s/m and a mass porosity PM of about 75%, it is possible to predict that this material has an excellent performance in terms of sound absorption.

According to other embodiments of the present invention, the sound-absorbing element 1 may also comprise different layers of fibrous material situated at a certain (constant or variable) distance from each other, this expression being understood as meaning that several layers of material are struck in succession by the sound wave which is propagated towards the surface 2.

Figure 14B:
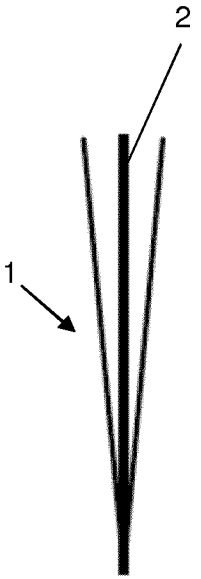
FIGS. 14*a* and 14*b* show yet other embodiments of sound-absorbing systems according to the present invention.
Figure 14A:
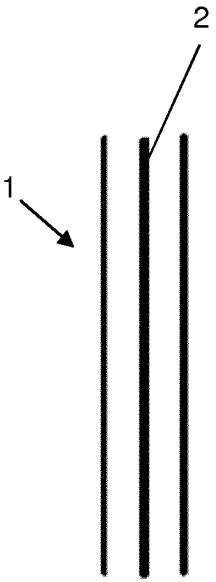

FIGS. 10 and 11*a*-11*e* show some examples of embodiment of the sound-absorbing element 1 comprising two layers of fibrous material 11, 12. FIGS. 13*a*-13*e* show some examples of embodiment of the sound-absorbing element 1 comprising three layers of fibrous material. FIGS. 14*a* and 14*b* show other examples which will be described below. The sound-absorbing elements shown in the said Figures are provided by way of a non-limiting example of the present invention.

Figure 10:
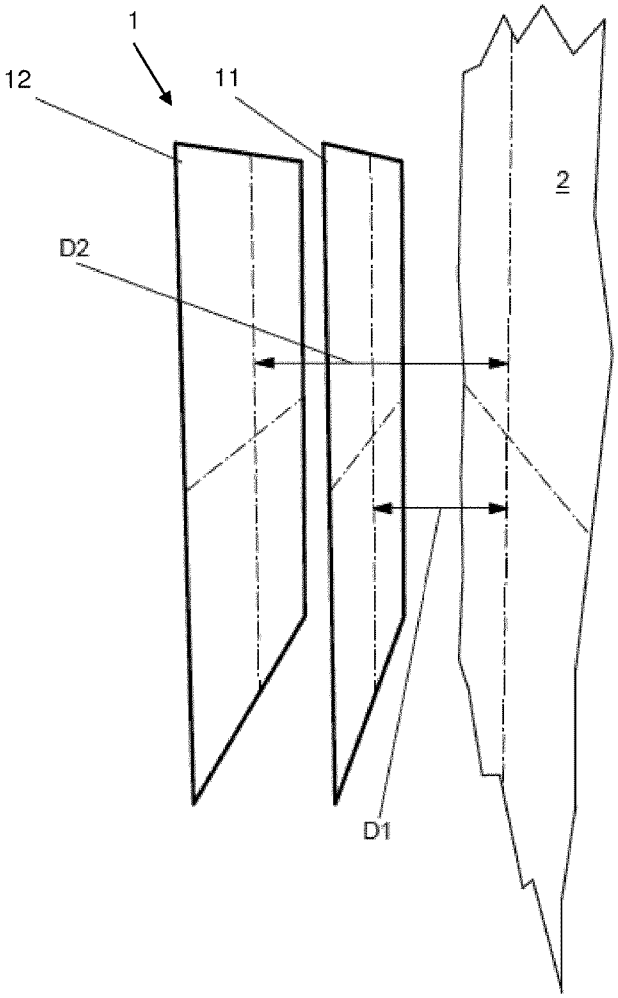
FIG. 10 shows a sound-absorbing element with a double layer of fibrous material according to an embodiment of the present invention, cooperating with a surface.
Figure 11A:
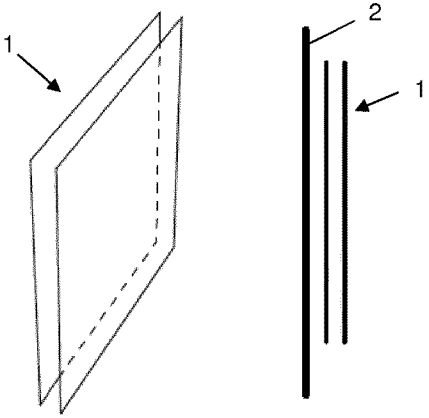
FIGS. 11*a*-11*e* show other embodiments of double-layer sound-absorbing elements and sound-absorbing systems according to the present invention.

According to different embodiments of the present invention, the layers of fibrous material may be layers physically separated from one another and positioned alongside each other in parallel, as shown in FIGS. 10, 11*a* (axonometric view on the left and side view on the right) and FIG. 13*a* (axonometric view on the left and side view on the right). In particular, according to the embodiment shown in FIG. 10, the sound-absorbing element 1 may comprise two separate and parallel layers of fibrous material in the form of parallel flat panels (below, this sound-absorbing element will be indicated also as "double-layer sound-absorbing element". In particular, the sound-absorbing element 1 according to FIG. 10 comprises a first panel 11 located at a distance D1 from the surface 2, and a second panel located at a distance D2 from the surface 2. In this case also, the expression according to which the first panel 11 (or the second panel 12) is located at a distance D1 (D2) from the surface 2 means that at least one portion of the first panel 11 (second panel 12) is located at a distance D1 (D2) from the surface 2.

Figure 12:
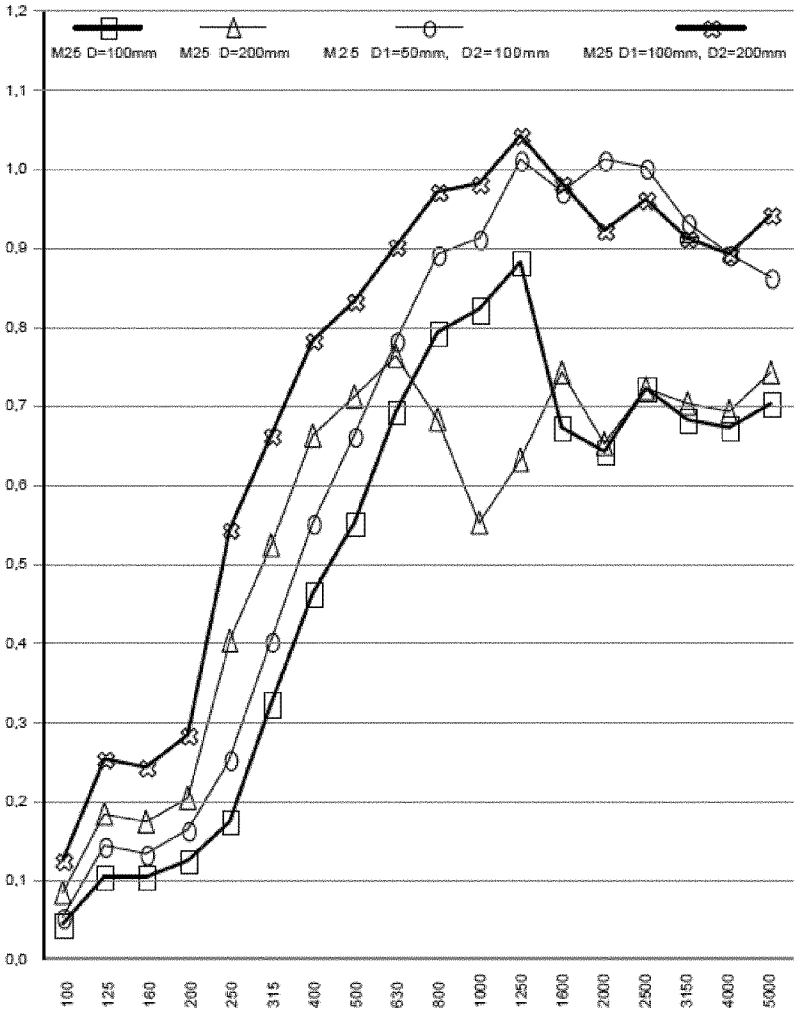
FIG. 12 is a graph which shows the diffuse incidence absorption coefficient values measured, at the Certification Institute, for a material considered, in a single-layer and double-layer sound-absorbing element.

The inventor carried out a number of tests to measure the diffuse incidence absorption coefficient of sound-absorbing elements of the type shown in FIG. 10, upon variation in the fibrous material used for the panels 11 and 12. In particular, the inventor carried out a number of tests at the Certification Institute "Istituto Giordano", situated in Gatteo (FC, Italy) already mentioned, in order to measure the diffuse absorption coefficient of a sound-absorbing element comprising two panels of material M(25). The results of these tests are shown in FIG. 12. The frequency in Hz is shown along the x-axis. In FIG. 12 the square-shaped graphical markers indicate the diffuse incidence absorption coefficient for a single-layer sound-absorbing element (such as that shown in FIG. 1) made of material M(25) with an air gap of 100 mm; the triangular-shaped graphical markers indicate the diffuse incidence absorption coefficient for a single-layer sound-absorbing element (such as that shown in FIG. 1) made of material M(25) with an air gap of 200 mm; the oval-shaped graphical markers indicate the diffuse incidence absorption coefficient for a double-layer sound-absorbing element (such as that shown in FIG. 10) made of material M(25) with an air gap of 50 mm between the first panel 11 and the surface 2, and an air gap of 100 mm between the second panel 12 and the surface 2; the cross-shaped graphical markers indicate the diffuse incidence absorption coefficient for a double-layer sound-absorbing element (such as that shown in FIG. 10) made of material M(25) with an air gap of 100 mm between the first panel 11 and the surface 2, and an air gap of 200 mm between the second panel 12 and the surface 2.

As can be seen from the graphs in FIG. 12, the presence of a double panel of fibrous material M(25) increases the performance of the sound-absorbing element 1 in terms of sound absorption compared to the case where the sound-absorbing element 1 comprises a single panel of material M(25). The improved performance may be noted in particular for frequencies higher than about 600 Hz. This performance improves further, also for frequencies lower than 600 Hz, if there is an increase in the thickness of the air gaps between the first panel 11 made of material M(25) and the surface 2 and between the second panel 12 and the first panel 11.

Figure 11B:
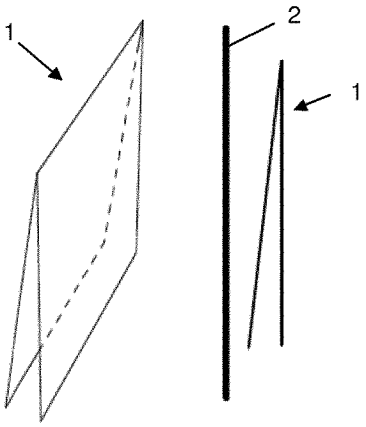
Figure 11C:
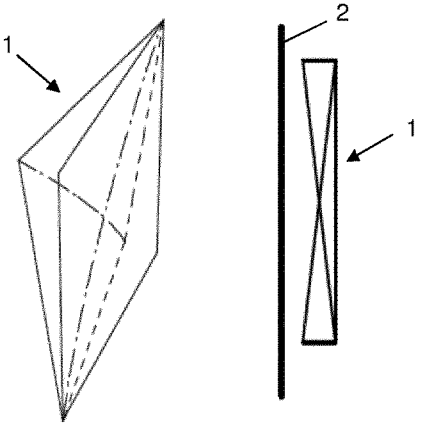
Figure 11D:
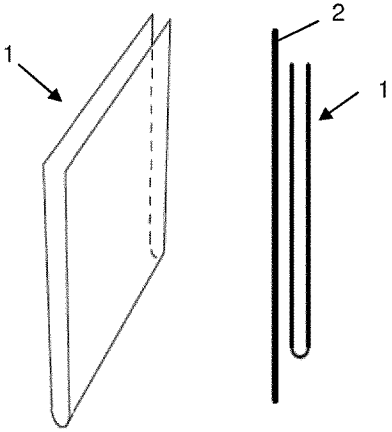
Figure 11E:
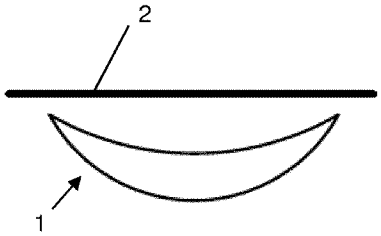

FIGS. 11*b*-11*d* show some embodiments of the sound-absorbing element 1 in a configuration with a double layer of fibrous material. Each of these figure shows, on the left, an axonometric view of the sound-absorbing element 1 and, on the right, a side view of the sound-absorbing element 1 and the surface 2. As shown in the Figures, the distance between one layer and the adjacent layer may not be uniform (for example one layer may be inclined with respect to the adjacent layer, as shown in FIG. 11*b*). Also alternatively, the layers may be attached to each other, as shown in FIGS. 11*b* and 11*c*, or may obtained from successive folds of the fibrous material, as shown in FIG. 11*d*. FIG. 11*e* is a side view of a further embodiment of the double-layer sound-absorbing element 1, in which said element 1 cooperates with a horizontal surface 2 (for example, the ceiling) of a room.

FIGS. 13*b*-13*e* show some embodiments of the sound-absorbing element 1 in a configuration with a triple layer of fibrous material. The embodiments shown correspond to those shown in FIGS. 11*b*-11*e* described hereinabove and therefore will not be further described.

FIGS. 14*a* and 14*b* show a side view of other two embodiments of the present invention in which one or more layers of fibrous material of the sound-absorbing element 1 are positioned on both sides of a surface 2 which may be a rigid panel. In turn the panel 2 may be a panel which is fixed or movable by means of wheels or equivalent means. The fibrous panel may be physically separated from the rigid panel 2 and positioned parallel thereto, as shown in FIG. 14*a*, or may be attached to the panel 2 on one or both sides of the panel, as shown in FIG. 14*b*.

The invention claimed is:

1. A sound-absorbing element comprising a fibrous material having the following properties:

a specific airflow resistance between 527 and 1552 [Pa s/m]; and a mass porosity between 66% and 79%.

2. The sound-absorbing element according to claim 1, wherein said fibrous material has a specific airflow resistance comprised between 723 and 1213 [Pa s/m] and a mass porosity comprised between 74% and 77%.

3. The sound-absorbing element according to claim 1, wherein the fibrous material comprises a fabric.

4. The sound-absorbing element according to claim 3, wherein said fabric is an artificial fabric.

5. The sound-absorbing element according to claim 4, wherein the warp of said fabric comprises a number of yarns per centimeter comprised between 5 and 40.

6. The sound-absorbing element according to claim 4, wherein the weft of said fabric comprises a number of yarns per centimeter comprised between 5 and 40.

7. The sound-absorbing element according to claim 3, comprising one or more layers of said fabric.

8. A sound-absorbing system comprising a sound-absorbing element according to claim 1, further comprising a surface cooperating with said sound-absorbing element.

9. The sound-absorbing system according to claim 8, wherein said surface is at a given distance from at least a portion of the sound-absorbing element.

10. The sound-absorbing system according to claim 9, wherein said distance is comprised between about 1 cm and about 30 cm.

* * * * *